US007806165B2

(12) United States Patent
Kroos et al.

(10) Patent No.: US 7,806,165 B2
(45) Date of Patent: Oct. 5, 2010

(54) METHOD FOR MAKING HOT STRIPS OF LIGHTWEIGHT CONSTRUCTION STEEL

(75) Inventors: Joachim Kroos, Meine (DE); Karl-Heinz Spitzer, Clausthal-Zellerfeld (DE); Georg Frommeyer, Erkrath (DE); Volker Flaxa, Salzgitter (DE); Udo Brüx, Meerbusch (DE); Klaus Brockmeier, Duisburg (DE)

(73) Assignees: Salzgitter Flachstahl GmbH, Salzgitter (DE); Max-Planck-Institut Für Eisenforschung GmbH, Düsseldorf (DE)

( * ) Notice: Subject to any disclaimer, the term of this patent is extended or adjusted under 35 U.S.C. 154(b) by 638 days.

(21) Appl. No.: 10/596,781

(22) PCT Filed: Dec. 22, 2004

(86) PCT No.: PCT/DE2004/002817

§ 371 (c)(1), (2), (4) Date: Mar. 20, 2007

(87) PCT Pub. No.: WO2005/061152

PCT Pub. Date: Jul. 7, 2005

(65) Prior Publication Data

US 2007/0289717 A1 Dec. 20, 2007

(30) Foreign Application Priority Data

Dec. 23, 2003 (DE) ..... 103 61 952
Dec. 14, 2004 (DE) ..... 10 2004 061 284

(51) Int. Cl.
*B22D 11/00* (2006.01)
*B22D 11/06* (2006.01)

(52) U.S. Cl. ..... 164/463; 164/479; 164/423

(58) Field of Classification Search ..... 164/462, 164/423, 463, 479
See application file for complete search history.

(56) References Cited

U.S. PATENT DOCUMENTS 3,795,269 A * 3/1974 Leconte et al. ..... 164/472
4,027,716 A * 6/1977 Theobald et al. ..... 164/19
4,588,021 A * 5/1986 Bergeron et al. ..... 164/432
6,354,364 B1 * 3/2002 Roder et al. ..... 164/472
6,358,338 B1 * 3/2002 Guelton et al. ..... 148/547
6,387,192 B1 * 5/2002 Frommeyer et al. ..... 148/329
6,755,236 B1 * 6/2004 Sivilotti et al. ..... 164/431
2006/0179638 A1 * 8/2006 Engl et al. ..... 29/527.7

FOREIGN PATENT DOCUMENTS

| | | |
|---|---|---|
| EP | 0 889 144 | 1/1999 |
| EP | 1 067 203 | 1/2001 |
| JP | 07 109546 | 4/1995 |

OTHER PUBLICATIONS

Spitzer K-H et al., "Direct Strip Casting (DSC)—An Option for the Production of New Steel Grades", Dec. 11, 2003, Steel Research, Duesseldorf, DE, pp. 724-731, XP009028744, ISSN: 0177-4832.*

Spitzer K-H et al.: "Direct Strip Casting (DSC)—An Option for the Production of New SteelGrades", Dec. 11, 2003, Steel Research, Duesseldorf, DE, pp. 724-731, XP009028744 ,ISSN: 0177-4832.

Grässel O et al.: "Phase Transformations and Mechanical Properties of Fe-Mn-Si-Al TRIP Steels:", Nov. 1997, Journal de Physique IV, Editions DE Physique. Les Ulis Cedex, FR, pp. 383-388, XP002081702, ISSN: 1155-4339.

Sugimoto K et al.: "Stretch-Flangeability of a High-Strength TRIP Type Bainitic Sheet Steel", 2000, ISIJ International, vol. 40, Iron and Steel Institute of Japan, Tokyo, JP, pp. 920-926, XP001182010, ISSN 0915-1559.

* cited by examiner

*Primary Examiner*—Kevin P Kerns
(74) *Attorney, Agent, or Firm*—Henry M. Feiereisen; Ursula B. Day

(57) ABSTRACT

In a method for making hot strips, a workable lightweight construction steel is used which in particular can easily be deep-drawn cold and includes the main elements Si, Al and Mn, with high tensile strength and good TRIP and/or TWIP characteristics. The mass % are as follows for C 0.04 to <1.0, Al 0.05 to <4.0, SI 0.05 to ≦6.0; Mn 9.0 to ≦30.0, the remainder being iron with the common incidental steel elements. The melt is cast in a horizontal strip casting unit, close to the final dimensions at calm flow and without bending to form a pre-strip in the range between 6 and 15 mm, and subsequently is fed for further processing.

25 Claims, No Drawings

METHOD FOR MAKING HOT STRIPS OF LIGHTWEIGHT CONSTRUCTION STEEL

BACKGROUND OF THE INVENTION

The invention relates to a method of making hot strips of a workable lightweight construction steel which in particular can be easily deep-drawn cold.

The hotly contested automobile market forces the manufacturer to continuously look for solutions to lower the consumption of the fleet while retaining highest possible comfort. Weight saving plays hereby a crucial role. To address this desire, the suppliers, especially in the area of the body, use steel of higher strength, without adversely affecting buckling resistance as well as workability to deep-draw and/or stretch-form and the coating.

EP 0 889 144 A1 proposes a solution, using a cold-workable austenitic lightweight construction steel, which in particular can easily be deep-drawn and has a tensile strength of up to 1100 MPa. The main elements of this steel are Si, Al, and Mn in the range of 1 to 6% Si, 1 to 8% Al, and 10 to 30% Mn, the remainder being iron, including common incidental steel elements.

The high deformation degree is realized by TRIP (Transformation Induced Plasticity) and TWIP (Twinning Induced Plasticity) characteristics of the steel. Steels with high Mn content tend to segregate as experienced during conventional extrusion as a result of bending, bulging of the strand, sedimentation, and segregation by suction in the sump peak area.

The macrosegregation, obtained in this way and possibly resulting also in intermetallic phases, causes major strip defects during hot rolling.

In general, high-alloy steels also have a tendency for internal cracking, which ultimately also represent macrosegregation defects. They are caused, e.g., by bending stress during production.

SUMMARY OF THE INVENTION

The invention is based on the object to provide a method of making hot strips from a workable lightweight construction steel which in particular can be easily deep-drawn cold, to obviate the afore-stated drawbacks.

According to the teaching of the invention, the steel has contents in mass-% for C 0.04 to ≦1.0

Al 0.05 to <4.0

Si 0.05 to ≦6.0

Mn 9.0 to ≦30.0, the remainder being iron including common incidental steel elements, wherein a melt is cast in a horizontal strip casting unit, close to final dimensions at calm flow and without bending, to form a pre-strip in the range between 6 and 15 mm, and subsequently is fed for further processing. Cr, Cu, Ti, Zr, V, and Nb, may, optionally, be added to the steel melt depending on requirements.

The steel according to the invention is configured with a structure that is either realized as stabilized γ crystal or as part-stabilized γ mixed crystal with defined stacking-fault energy, exhibiting a partly multiple TRIP effect.

The last-mentioned effect is the transformation of a face-centered γ mixed crystal into a martensitic ϵ-structure with closest hexagonal packing of spheres which is then partly transformed into a body-centered α-martensite and residual austenite.

$$\gamma_{fcc} \rightarrow \varepsilon \frac{Ms}{hcp} \rightarrow \alpha \frac{Ms}{bcc}$$

fcc=face-centered cubic bcc=body-centered cubic hcp=hexagonal closed packed

Numerous tests have shown that the carbon content is crucial for the complex interaction between Al, Si and Mn. It increases the stacking-fault energy on one hand, and expands the metastable austenite range on the other hand. As a consequence, the transformation induced martensitic formation and the thus accompanying solidification is inhibited and the ductility is also increased.

Further improvements can be realized by targeted addition of copper and/or chromium. Addition of copper stabilizes ϵ-martensite and improves the galvanizing capability. Also chromium stabilizes ϵ-martensite and improves corrosion resistance.

The advantage of the proposed lightweight construction steel resides in the possibility to cover a broad range of strength and ductility demands by tailoring the alloy composition and selection of process parameter such as deformation degree and heat treatment, allowing tensile strengths of up to 1400 MPa. The addition of carbon plays hereby a key role.

Heretofore, the skilled artisan was of the opinion to reduce the carbon content as far as possible to zero so as to prevent the formation of κ-carbides. This invention overcomes this preconception by proposing a balanced ratio in the addition of aluminum and manganese, thereby allowing also a targeted addition of carbon.

For the phenomenon "delayed fracture" that may be encountered in steels with predominantly TRIP characteristics, the content of hydrogen in steel plays an important role. The phenomenon manifests itself in the presence of cracks in the edge area of, e.g., deep-drawn cups after a while. The crack formation process may last several days.

For that reason, it is proposed to limit the hydrogen content to <20 ppm, preferably to <5 ppm. This can be accomplished through careful treatment during melting, e.g. by a particular rinsing and vacuum treatment.

Depending on requirement, it may be necessary to provide the lightweight construction steel predominantly with TRIP or TWIP characteristics. In a simplest case, this can be implemented by controlling the Mn content. When selecting a lower range of about 9-18%, an end product can be expected to have predominantly TRIP characteristics, while a selection of a preferred upper range of about 22-30% results in predominantly TWIP characteristics. As already stated above, this control is possible also by tailoring the addition of other elements, in particular carbon. In this context, it should be noted that as far as sufficient corrosion resistance is concerned, the selection of a higher Cr content for the lower Mn range, and the selection of a lower Cr content for the upper Mn range is advantageous.

To implement the process, it is proposed to realize the flow calmness by employing a conjointly running electromagnetic brake which provides in the ideal situation that the speed of melt feed corresponds to the speed of the revolving conveyor band.

Any detrimental bending during solidification is prevented by supporting the casting band, which receives the underside of the melt, on a plurality of rollers disposed side-by-side. The support is amplified by generating an underpressure in the area of the casting band so that the casting band is pressed firmly against the rollers.

In order to maintain these conditions during the critical phase of the solidification, the length of the conveyor band is so selected that the pre-strip is substantially through solidified at the end of the conveyor band before its deflection.

A homogenization zone follows the end of the conveyor band and is utilized to effect a temperature compensation and possible reduction in tension. This is followed by a further treatment which may involve a direct coiling of the pre-strip or a preceding rolling process to provide the required deformation of at least 50%, preferably of >70%.

Direct coiling of the pre-strip has the advantage that the casting speed can be selected to realize optimum conditions for solidification, regardless of the cycle of the following rolling process.

On the other hand, it may be advantageous in particular for economical reasons (higher productivity) to roll the material according to the invention directly after the casting inline in its entirety or partly to its final thickness.

When the strand shell is formed at the start of solidification, the strand shell may locally detach from the revolving band of the strip casting unit. This possibly results in inadmissible unevenness on the underside of the pre-strip. To prevent this, it is necessary to ensure as far as possible same cool-down conditions for all surface elements of the forming strand shell of a strip that extends across the width of the conveyor band. This can be attained by conditioning the topside of the revolving band, e.g., through tailored structuring or through application of a thermally insulating separation layer.

One of the afore-mentioned structuring measures involves, e.g., sand blasting or brushing of the topside of the revolving band. An example for a thermally insulating separation layer involves coating through plasma spraying with aluminum oxide or zirconium oxide, for example. A further exemplary embodiment for structuring involves the configuration of a nub structure, e.g. with upwardly directed nubs of few 100 μm height and few millimeters diameter as well as a spacing between the nubs of few millimeters.

The attainable values are demonstrated with reference to an exemplary embodiment. Originating from a steel with the analysis

C=0.06%

Mn=15.5%

Al=2.0%

Si=2.6%

$H_2$=4 ppm, a hot strip has been manufactured at a thickness of 2.5 mm.

The tensile specimen lying in rolling direction resulted in a tensile strength of 1046 MPa and an elongation (A80) of 35%. Depending on the deformation degree and heat treatment, the tensile strength may be increased up to above 1100 MPa and the elongation (A80) above 40%.

A second example shows the possibility to shift the strength and ductility characteristics relative to one another through an increase in carbon content at almost same Mn content.

Steel of this exemplary embodiment has the following contents:

C=0.7%

Mn=15%

Al=2.5%

Si=2.5%

$H_2$=3 ppm

The cold strip of 1.0 mm made from this steel is annealed for recrystallization under inert gas at 1050° C. and a retention time of 15 minutes. The tensile strength is lowered to 817 MPa, while the A80 elongation rose to 60%. This means that despite the low Mn content as a consequence of the higher carbon addition, the steel has been shifted more into the range with TWIP characteristics.

A further example shows the results with high Mn content and low carbon content. The contents amounted to

C=0.041%

Mn=25%

Al=3.4%

Si=2.54%

$H_2$=4 ppm

Following a comparable heat treatment, as described above, the tensile strength was on average 632 MPa and the A80 elongation 57%. Also this example clearly demonstrates the substantial increase in elongation with high Mn contents at the expense of strength however, so long as the carbon content is low.

In summary, the three examples show the broad variation with respect to strength and elongation, with the Mn and C contents playing a key role. The analysis impact is compounded by treatments of the hot strip in the form of annealing and/or combined cold forming (e.g. rolling, stretching, deep drawing) and intermediate annealing or final annealing.

BRIEF DESCRIPTION OF THE DRAWING

None

DETAILED DESCRIPTION OF PREFERRED EMBODIMENTS

None

What is claimed is:

1. A method of making a hot strip, comprising the steps of:

providing a melt of a lightweight construction steel with high tensile strength and with TRIP and/or TWIP characteristics, said construction steel comprising Si, Al and Mn as main elements and containing in mass-%

C 0.04 to <1.0

Al 0.05 to <4.0

Si 0.05 to <6.0

Mn 9.0 to <30.0, the remainder being iron including incidental steel elements;

feeding the melt onto a revolving conveyor band of a horizontal strip casting unit to shape the melt close to a final dimension at calm flow and without bending, thereby forming a shell as the melt progressively solidifies across a width of the conveyor band and producing a pre-strip in the range between 6 and 15 mm;

conditioning a top side of the conveyor band by a single-step structuring of the top side to effect same cool-down conditions across a width of the conveyor band;

cooling the shell substantially equally across the width of the conveyor band; and transferring the pre-strip for further processing.

2. The method of claim 1, wherein the carbon content amounts to 0.06 to <0.7%.

3. The method of claim 1, wherein the construction steel contains Cr up to <6.5%.

4. The method of claim 1, wherein the Mn content amounts to 9-18%.

5. The method of claim 1, wherein the Mn content amounts to 18-22%.

6. The method of claim 1, wherein the Cr content amounts to 0.3-1.0%.

7. The method of claim 1, wherein the Mn content amounts to 22-30%.

8. The method of claim 1, wherein the Cr content amounts to 0.05-0.2%.

9. The method of claim 1, wherein the Si content amounts to 2.0-4.0%.

10. The method of claim 1, wherein the Al content amounts to 2.0-3.0%.

11. The method of claim 1, wherein the construction steel has a hydrogen content of <20 ppm.

12. The method of claim 1, wherein the construction steel has a hydrogen content of <5 ppm.

13. The method of claim 1, wherein the construction steel contains Cu of up to <4%.

14. The method of claim 1, wherein the construction steel contains titanium and zirconium in total of up to <0.7%.

15. The method of claim 1, wherein the construction steel contains niobium and vanadium in total of up to <0.06%.

16. The method of claim 1, wherein the construction steel contains titanium, zirconium, niobium and vanadium in total of up to <0.8%.

17. The method of claim 1, wherein the melt is fed onto the revolving conveyor band at a speed which is identical to a speed of the conveyor band.

18. The method of claim 17, wherein the melt on the conveyor band is substantially through solidified at an end of the conveyor band.

19. The method of claim 1, further comprising the step of subjecting the pre-strip to a homogenization zone after the feeding step but before the transferring step.

20. The method of claim 1, wherein the further processing involves a coiling of the pre-strip.

21. The method of claim 1, further comprising the steps of inline rolling the pre-strip and coiling up the pre-strip.

22. The method of claim 21, wherein the pre-strip is subjected to a deformation degree of at least 50%.

23. The method of claim 1, wherein the melt is subjected to a deformation degree of >70%.

24. The method of claim 1, wherein the structuring step includes a process selected from the group consisting of sand blasting, brushing of the top side, and applying a nub structure.

25. The method of claim 1, wherein the structuring step includes the step of applying a thermally insulating separation layer on the top side of the conveyor band by plasma spraying with aluminum oxide or zirconium oxide.

* * * * *

UNITED STATES PATENT AND TRADEMARK OFFICE

CERTIFICATE OF CORRECTION

PATENT NO. : 7,806,165 B2
APPLICATION NO. : 10/596781
DATED : October 5, 2010
INVENTOR(S) : Joachim Kroos et al.

It is certified that error appears in the above-identified patent and that said Letters Patent is hereby corrected as shown below:

On the Cover Page, line 5 of the Abstract, change "<1.0" to --≤1.0--;

In the Claims:

Column 4, line 50, Claim 1 change "<1.0"; to --≤1.0--;

Column 4, line 52, Claim 1 change "<6.0"; to --≤6.0--;

Column 4, line 53, Claim 1 change "<30.0"; to --≤30.0--;

Column 5, line 2, Claim 2 change "<0.7%"; to --≤0.7%--;

Column 5, line 4, Claim 3 change "<6.5%"; to --≤6.5%--;

Column 5, line 25, Claim 13 change "<4%"; to --≤4%--;

Column 5, line 27, Claim 14 change "<0.7%"; to --≤0.7%--;

Column 5, line 29, Claim 15 change "<0.06%"; to --≤0.06%--; and

Column 6, line 3, Claim 16 change "<0.8%"; to --≤0.8%--.

Signed and Sealed this
Eighteenth Day of January, 2011

David J. Kappos

David J. Kappos
*Director of the United States Patent and Trademark Office*